US006537605B1

(12) United States Patent
Kirchner et al.

(10) Patent No.: US 6,537,605 B1
(45) Date of Patent: Mar. 25, 2003

(54) METHOD AND DEVICE FOR COATING HIGH TEMPERATURE COMPONENTS BY MEANS OF PLASMA SPRAYING

(75) Inventors: Franz Kirchner, Erlangen (DE); Dieter Raake, Oberhausen (DE); Helge Reymann, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/763,081

(22) PCT Filed: Aug. 3, 1999

(86) PCT No.: PCT/DE99/02381

§ 371 (c)(1),
(2), (4) Date: Apr. 20, 2001

(87) PCT Pub. No.: WO00/11234

PCT Pub. Date: Mar. 2, 2000

(30) Foreign Application Priority Data

Aug. 18, 1998 (DE) ..... 198 37 400

(51) Int. Cl.[7] ..... C23C 4/00; B05C 5/04

(52) U.S. Cl. ..... 427/8; 427/446; 118/666; 118/712; 118/302

(58) Field of Search ..... 427/446, 8; 118/666, 118/712, 302

(56) References Cited

U.S. PATENT DOCUMENTS

| | | | | |
|---|---|---|---|---|
| 4,656,331 A | * | 4/1987 | Lillquist et al. | 219/121.34 |
| 5,047,612 A | * | 9/1991 | Savkar et al. | 219/121.47 |
| 5,111,048 A | | 5/1992 | Devit | |
| 5,165,795 A | * | 11/1992 | Hauffe | 314/45 |
| 5,731,030 A | * | 3/1998 | Friese et al. | 427/8 |

FOREIGN PATENT DOCUMENTS

| | | |
|---|---|---|
| DE | 0 446 226 A1 | 6/1991 |
| GB | 220065 | 8/1924 |

* cited by examiner

*Primary Examiner*—Katherine A. Bareford
(74) *Attorney, Agent, or Firm*—Eckert Seamans Cherin & Mellott, LLC

(57) ABSTRACT

The invention relates to a method for coating high-temperature components (10) by means of plasma spraying. An infrared camera (20) is used to determine the distribution of the thermal radiation (30) of the component surface (40), and to determine therefrom the temperature distribution (70) in accordance with which a method parameter (p) is set in order to reach a threshold temperature (Ts). The invention also relates to a coating device for producing a coating (15) while monitoring the surface temperature by means of an infrared camera (20).

24 Claims, 5 Drawing Sheets

METHOD AND DEVICE FOR COATING HIGH TEMPERATURE COMPONENTS BY MEANS OF PLASMA SPRAYING

BACKGROUND

1. Field of the Invention

The invention relates to a method for coating high-temperature components by means of plasma spraying, in particular gas turbine components. The invention also relates to a coating device having an infrared camera.

2. Related Art

In addition to other thermal coating methods, because of its flexible use options and a good economic balance, plasma spraying is of great importance in the production of coatings for protecting components, for example against corrosion by hot gases. Vacuum plasma spraying (VPS), low-pressure plasma spraying (LPPS) and atmospheric plasma spraying, inter alia, are among the various known methods.

In plasma spraying technology, a coating is produced by directing a very hot plasma jet onto the substrate to be coated while feeding material which is to be applied. The coating material is present in this case mostly as powder or wire and is fused during transport by the plasma jet before striking the substrate. It is therefore possible in principle to produce the most varied layer thicknesses using very different coating materials and substrate materials. It is possible to use metal powder and ceramic powder in the most varied mixtures and grain sizes as long as the starting material has a defined melting point. An MCrAlY layer, M standing for the metals Ni and Co, is used, for example, to coat gas turbine buckets with a layer protecting against corrosion by hot gases.

The type and quality of the layer is influenced, inter alia, by the pore content, the oxide and nitride content and by its adhesive properties. In addition to the roughness of the surface, the mutual diffusion of the different materials or chemical reactions are important adhesion mechanisms. It is frequently necessary to apply an adhesion promoter layer before applying the actual protection layer, in particular whenever there is a need to balance different coefficients of thermal expansion.

Various methods are applied to monitor the quality of the coating. Preference is to be given in this case to nondestructive tests such as are provided by ultrasonic or infrared technology, for example. In the case of the first-named methods, it is frequently disadvantageous that the inspection instruments touch the surface of the workpiece, thereby limiting the use options, for example to specific component geometries. Furthermore, errors frequently occur owing to surface contamination and surface irregularities or other surface anomalies. The inspection of the component consists in observation over a large area and in an averaging fashion.

Many of these disadvantages are eliminated in the case of infrared technologies. They are based on the fact that, in a fashion correlated with the temperature of the component, each material absorbs and emits electromagnetic radiation which is recorded by infrared detectors. The infrared methods can be used quickly and flexibly and can be applied without difficulty with controlling and regulating systems.

An infrared thermography method represented in U.S. Pat. No. 5,111,048 can be used to detect cracks which arise, for example, due to stresses in the layers. In this case, laser radiation is used to produce contrast between the fault positions and the remainder of the surface. By contrast with the undisturbed surface,fault positions exhibit other absorption or emission properties of electromagnetic radiations. It is disadvantageous, inter alia, that this method cannot be used in a coating chamber during coating, and that the radiation must firstly be excited by external radiation means independently of the heating.

A device and a method for inspecting the thickness and the faults of the coating by means of an infrared technique is described in GB 2 220 065. In this case, the coated component is irradiated by a short infrared pulse and the response beam is recorded by an infrared camera. The region to be inspected is illuminated in this case more homogeneously than in the method described above. It is disadvantageous, inter alia, that at higher process temperatures the infrared radiation of the heated component and of the flash lamp overlap in a way which is difficult to separate for the purpose of detection and evaluation provided in the measurement method.

The monitoring methods set forth above and others, as well, are generally carried out after fabrication of the coating. However, it is desirable to carry out online monitoring as early as during the coating, in order to intervene for control purposes, if required, and/or to control the method with the aid of the results. Moreover, monitoring and control, associated therewith, of the method parameters is indicated during the process in order to ensure the quality and to improve the method.

A method for online monitoring of the coating during the coating operation is described in U.S. Pat. No. 5,047,612. An infrared detector is used to determine the position of the jet spot of the plasma jet on the component to be coated, and the application of the coating is influenced during the coating by controlling the powder flow and the carrier gas of the powder. It is disadvantageous in this case that the setting of process parameters is performed essentially independently for each component. The control of the powder distribution does not, moreover, constitute per se a sufficient condition for a reliable adhesion of the coating which satisfies the operating requirements.

By contrast, the surface temperature of the component to be coated is of fundamental importance for forming the various protective functions of the coating. The abovementioned MCrAlY layers achieve their protective function by, for example, forming aluminum oxide or chromium oxide layers. Attack by oxidation, in particular, is thereby prevented in the base material. The oxide layers are formed differently depending on the surface temperature of the component. In accordance with recent results, the surface temperature of the substrate and the temperature gradient on the component surface are likewise to be accorded greater importance for the adhesion of different metal/ceramic layers in the plasma spraying process (see, for example, Proc. Int. Therm. Spr. Conf. 1998, Nice, France, pages 1555 ff.).

Pyrometers are frequently used at a point on the surface of the component which is to be freely defined for the purpose of temperature measurement during plasma spraying. However, these supply only point measurements, and in the event of a movement of the bucket during the conduct of the process there is a risk that pyrometric temperature measurement will be carried out at differing locations on the bucket surface. The temperature measured in this way is therefore subject to large fluctuations which cannot be calculated.

It is therefore the object of the present invention to improve the initially mentioned method/the initially mentioned device such that the quality of the layers produced can be observed and set reliably and reproducibly during the coating method

SUMMARY OF THE INVENTION

An area-wide overview of the component surface is obtained in real time by means of measuring the thermal distribution of a surface region of the component with the aid of an infrared camera for the purpose of the present invention. Measurement of the thermal radiation with the aid of an infrared camera has certainly already been used to monitor the application of powder during plasma coating, for example in the abovenamed known method according to U.S. Pat. No. 5,047,612. By contrast, in the present invention the exact absolute temperature distribution of the overall component surface or of selected, predetermined sections of the component surface is determined exactly and as a function of time. An infrared camera according to the invention corresponds to an infrared-sensitive CCD array with optical systems for imaging the component on the CCD array, and to intensity- or frequency-dependent evaluation devices. The temperature distribution is determined from the thermal distribution by comparing the thermal radiation of the component surface measured using the infrared camera with a radiation reference means. Setting the thermal distribution and/or the temperature distribution determined therefrom with the aid of an adjustable method parameter in a fashion associated with the measurement of the thermal distribution or the temperature distribution is essential to the present invention. By setting the method parameter, the surface temperature is corrected with regard to its absolute magnitude for the purpose of reaching a threshold temperature.

The radiation reference means is brought by a heater to a temperature which can be set if required and is determined exactly by a temperature monitoring element. The thermal images of the radiation reference means taken with the camera can be assigned absolute temperature values in a simple way such as, for example by means of color comparisons or, for example in the case of an upstream radiation filter, by intensity comparisons, and these absolute temperature values can be transferred onto the thermal image of the component. The surface temperature of the component is then adjusted by setting the method parameter, and is brought reproducibly and accurately into a range which is advantageous for the formation and adhesion of layers, while taking account of the special properties of the surface region respectively present. An essential condition for good adhesion is then achieved when a threshold temperature is exceeded.

In general, color comparisons can be undertaken "by eye" with a high sensitivity. For example, setting a predetermined temperature of the radiation reference means close to the threshold temperature which is to be set results in a simple criterion, which can be monitored quickly and reliably, for exceeding or falling below the threshold temperature simply by visual comparison of the thermal radiation shots of the component and of the radiation reference element. However, it is also possible to make sensible use of evaluation by means of EDV, for example electronic comparison of color value or intensity.

The method of this invention provides reproducible results and ensures as early as during the coating operation that the adhesive properties of the layer to be applied are monitored exactly and in a way which can be handled variably. For reasons of clarity, the temperatures can even be set by hand while maintaining accuracy and reproducibility. The high spatial accuracy or a very good resolution has a favorable effect, in particular in the case of complex surface regions which are to be coated.

When producing relatively large batch-quantities of coatings for components, it is possible, by setting a tested method parameter, to achieve with simple steps an increase in the reproducibility of the coating results, an improvement in the reliability of the coating, and a constant high quality. This can also be carried out for quality assurance within the framework of quality management of such a process control. The proposed method is therefore well suited to the industrial production of coatings for high-temperature components.

It is advantageous, furthermore, to use the method parameter to set, in the surface region of the component, a temperature distribution for which predetermined temperature differences and/or temperature gradients are not exceeded. Inhomogeneities in the temperature distribution, in particular strong local fluctuations, that is to say large temperature gradients, can lead, despite a generally very high average temperature, to reduced adhesion of the coating. Temperature gradients can arise, for example, from uneven heating or varying component properties such as, for example, different thicknesses of the material. In addition to setting the parameter for the purpose of reaching a threshold temperature, it is possible by setting the parameter to limit temperature fluctuations of the surface by maintaining maximum temperature differences, and to set a uniform temperature distribution.

Furthermore, detecting the thermal radiation by means of an infrared camera can show temporal fluctuations in the temperature distribution, which result from power fluctuations in the heating source, for example, specifically in an in-situ fashion and with maximum temporal resolution, for example 10–50 images/sec. The parameter is advantageously set in this case on the basis of empirical values or measured values and by coordination with the measured, time-dependent temperature distribution.

The threshold temperature is advantageously set with regard to an optimum adhesive power of the coating on the component, and/or the temperature differences and/or temperature gradients are permitted for the same purpose only within predetermined limits. Different materials, in particular material combinations of layer material and substrate material, render it necessary when setting the temperature distribution of the surface regions of the components to achieve different threshold temperatures, and this is possible by varying the setting of the method parameter.

It is possible with the aid of the present invention to achieve a flexible, quick and accurate setting of the threshold temperature as required by setting the parameter as a function of the measured temperature distribution. In addition, there is a possibility of thereby adjusting to different component properties. By controlling the method parameter, it is possible to react individually to the temperature fluctuations, and limits of temperature differences required for the adhesion of the coating to be observed.

It is possible, furthermore, to use component-specific and material-specific parameters in the case of process monitoring and process control by hand or by means of EDV support. The influence of different material strengths, for example owing to the variations in the thermal conductivity of the components, can thereby also be taken into account. In applying multiple, and also different coatings to a component, the threshold temperatures, and thus the coating temperatures, can be adapted quickly and individually by means of stored, material-specific magnitudes of the method parameters.

It is proposed to set a predetermined threshold temperature in each case at a plurality of regions on the surface of the component. Preferably precisely at points on the component subject to particular loads in later use, for example parts of gas turbines subject to the hottest and strongest flows and mechanical loads, to ensure optimum adhesion, thus ensuring functionality. It is always possible by means of the present invention for these requirements to be fulfilled as necessary. A jet used to heat the component can be guided in accordance with the requirements over specific points on the component which cool more quickly. Simultaneous monitoring is provided virtually at any instant by observation and control with the aid of the infrared camera.

It is advantageous when the method parameter is controlled by comparing the temperature distribution of the surface region of the component with a desired temperature distribution. When certain temperature distributions have proved to be particularly advantageous in test measurements, trial runs and also during the actual coating, it is desirable to be able to use this temperature distribution for following coatings. Thus, if a constant temperature distribution with temperatures higher than a threshold temperature has proved to be sensible; the temperature distribution is then set for the entire surface in accordance with this constant temperature. This can be carried out quickly by hand. By using magnitudes of the process parameter stored in a control loop and checked, a temperature distribution can, moreover, be set after comparison with the temperature distribution of the component surface supplied by the infrared camera.

The component is advantageously preheated and/or heated during plasma spraying with a plasma jet, and a parameter of the plasma jet is set as the method parameter. The adhesion of the layer on the base material is positively influenced by a high preheating temperature. The preheating temperature is important for good adhesion not only of the first, but also of all subsequent layers applied in turn thereto, since these later layers can only adhere as well as the first ones. A temperature comparable to the preheating temperature should also be maintained during the plasma spraying, and is advantageously to be achieved by heating with the plasma jet. By comparison with inductive resistance heating, for example, heating with the plasma jet essentially ensures that the outer layers important for the coating are heated. The component material, which possibly cannot withstand the high temperatures over a lengthy time, is damaged only minimally. At the same time, the surface can be cleaned with the plasma jet, by polarization of the component, explained in more detail below, which also improves the adhesion. However, it is possible in this case, that stronger gradients are set up in the temperature distribution and counteract good adhesion. It is therefore advantageous when preheating the component to have the entire component viewed by the infrared camera, and to be able to control the method parameters accordingly.

Moreover, the two operations of heating and coating, which frequently overlap one another in an uncontrollable way during the plasma spraying process, can be monitored and controlled separately from one another by means of the method presented. The power of the plasma jet can be controlled as required by setting its method parameters. This permits a quick reaction to the results obtained by the infrared camera as regards the temperature distribution. Given the same travel path or the same scanning method of the beam on the, component surface, good reproducibility of the method can be ensured by storing and evaluating the data for the plasma jet. This ensures a better quality of the layers, and increased productivity.

In particular, the current of a radiation source of the plasma jet can be set as the method parameter. This variable can be controlled inexpensively and permits precise coordination of the energy input of the plasma jet into the surface of the component as required by the predetermined temperature distribution.

In the present method, the position of the component relative to the plasma jet can be varied, and the temperature distribution of the surface region of the component can be determined in different relative positions with respect to the plasma jet. It is possible in this way to undertake individual monitoring of the various surface regions of the component without needing to remove the component. The various component positions can be stored. This permits the component position to be assigned reproducibly to a magnitude of the method parameter. For applying the method for further components of the same type, it is sensible in this case to use stored data, for example the starting point or assignment of the component position, for the purpose of controlling the method parameter for each component of the series.

During plasma spraying, the component can be rotated with an optimum alignment of the rotation axis of the component relative to the infrared camera. Thus, the entire surface of the component can be coated completely and uniformly, and monitoring of the surface temperature distribution can be undertaken simultaneously by means of the infrared camera without altering the setting of the plasma jet. This monitoring function can be undertaken in the form of short-term measurements, that is to say separately for each surface region, taking account of the rate of rotation. The spatial resolution should be very precise in this case. In order to achieve the threshold temperature, it is possible to set the method parameters in a fashion adapted to the surface conditions.

Alternately, long-term measurements can be taken, that is to say measurements over times which vary in the range of several rotational periods. The result of these measurements are then average temperature values averaged over the time and the circumference of the rotating component in the direction of rotation. This type of measurement is quick and can be done inexpensively. The results can then be compared in turn with the threshold temperature.

The present plasma spraying device preferably comprises a holder for continuous rotation of the component about its longitudinal axis. This type of rotation can be carried out in a stable fashion and ensures the greatest possible effectiveness with regard to the coating rate and a uniform layer application. In order to ensure, simultaneously with good layer application, optimum measurement of the temperature distribution of the component surface as well, special conditions are advantageously set for the angular ratio of the rotation axis to the plasma jet and camera alignment. In particular, in this case one should avoid having the solid angle in which the plasma radiation is reflected intersect with the visual angle of the infrared camera. If not avoided, this setting would swamp out the entire shot as a result of camera receiving the direct and/or reflected radiation of the plasma jet. The infrared camera is therefore arranged outside the solid angle of reflection of the plasma jet.

The temperature distribution of the surface region of the component is advantageously determined as a function of time, and the method parameter is set in accordance with the temporal response of the temperature distribution. The infrared camera permits the entire temperature distribution to be recorded in one step. With regard to continuous monitoring of the development of layer quality, it is advantageous to detect the temperature distribution as a function of time, in order to determine the material response and the jet response, and to be able to set a corresponding, time-dependent function of the method parameter.

The positional variations of the component relative to the plasma jet, on the one hand, and a method parameter of the plasma spraying, on the other hand, can be coordinated with one another in accordance with the temperature distribution such that temperature gradients on the surface of the component are reduced. For example, the method parameter can be set such that less energy is transmitted per element of area. This can be done, for example, by moving the plasma jet more quickly relative to the component surface. The energy transmission per time unit remains the same, but is more uniformly distributed. This reduces the temperature gradient. On the other hand, too low an energy transmission can also cause the surface temperature to drop too sharply. The power of the plasma jet can then be raised. In order to achieve a high-quality surface layer, it is necessary to coordinate the various positions of the component precisely with the changes in the parameter in accordance with the determined temperature distribution.

When short-term shots are carried out during component rotation, it is advantageous to trigger successively occurring shots taken with the infrared camera as a function of the rotational period of the component. By shooting the same component regions in different states, it is possible to undertake precise measurement of the temporal temperature response of the surface temperatures, and to adjust the method parameter with the aid of the results. It would otherwise be impossible to exclude sources of error when determining and controlling the temperature, owing to the displacement of the surface region considered.

The triggering is carried out with a temporal spacing of a quarter of the rotational period or an integral multiple thereof. It is ensured in this way that either the front side or the rear side of the component, or the sides of the component, are inspected. The two sides can, for example in the case of a turbine bucket, have different forms and material thicknesses of the component, and therefore store the input energy of the plasma jet at different intensities. Consequently, different forms of temperature gradients are present, and this may require adjustment of the method parameter of the plasma jet.

It is proposed that the radiation reference means can be heated independently of the heater for plasma spraying. This permits the material of the radiation reference means to be heated completely and, in particular, uniformly, for example by inductive heating or direct heating, for example resistance heating. This supplies an important precondition for the correct surface-independent comparison of the temperatures of the reference means and the component to be coated.

Furthermore, the temperature of the radiation reference means is advantageously to be measured with the aid of a thermocouple. Determining the temperature with the aid of a thermocouple yields measured values which are independent of surface properties. After calibration, measurement with the aid of the thermal couple, or else another independent temperature-measuring element supplies reliable values of the absolute temperature which can be used for a comparison with the results of the thermal radiation measurements of the component by means of the infrared camera.

It is proposed that the radiation reference means is arranged in the measuring field of the camera inside the chamber next to the component to be coated. This permits the infrared camera to detect simultaneously the radiation reference means and the component to be coated. This can be particularly advantageous in the case of rapidly varying radiation conditions and reflections which can influence the measurement results. Detection in the same measuring field permits measurement under the same environmental conditions, and this is advantageous, in particular, with rotated or otherwise displaced components, because of the quickly changing visible surfaces. The environmental conditions are also substantially influenced by pollution by coating material on the observation window or by the infrared components in the radiation of the plasma jet. It is therefore particularly advantageous for the purpose of ensuring unfalsified measurement results to fit the radiation reference means inside the coating chamber.

The camera is arranged and designed such that it can be used to detect at least the entire surface, facing it, of a turbine bucket. Particularly when large temperature gradients are to be expected because of great differences in the component properties, for example in the component material thickness, it is advantageous to be able to cover the entire surface. The particular arrangement of the camera of the present invention permits this to be done without any problem. Particularly advantageous in this case is the detection, which is easy to carry out, and control of the temperature distributions of edge regions and regions of small radius of curvature such as occur in the case of turbine buckets in the region of the bucket ends. This is important because additional strong mechanical and thermal loads act there on the coating during use by comparison with flat surface regions.

The infrared camera is fitted at one end of an outwardly projecting stub of the coating chamber. A glass window is fitted at the end of the stub and permits a view into the coating chamber, which is provided with a seal for ensuring an effective vacuum and is thereby subject only to low pollution from process dust. The proposed device reduces the frequency at which the apparatus needs to be maintained and cleaned. It is favorable for the infrared camera shots when the stub has a conical shape with a wide, free angular aperture range. This shape is then adapted to the visual range of the infrared camera and permits optimum shots of the component.

The glass window advantageously consists of a special glass having a transmission for wavelengths between 2–5 $\mu$m which is adapted to the measuring range of the camera. This measuring range corresponds to that infrared radiation region in which a large fraction of the radiation of the component surface is emitted. This region of radiation is sufficiently well distinguishable from the mutually overlapping, wideband infrared fraction of the plasma jet. The wavelength region of 2–5 $\mu$m inspected is far removed from the maximum wavelength of the temperature radiation of the plasma jet and, by comparison with the other radiation regions of the plasma jet, is of lower intensity. In the case of the present online monitoring of the coating, in particular, this is important in order to obtain an accurate, well resolved and clear image of the temperature distribution of the surface of the component.

The glass window advantageously consists of sapphire glass. This type of glass, which contains $Al_2O_3$, has optimum transmission properties in the desired region. The glass is commercially available and can be adapted in functional terms to the device according to the invention.

BRIEF DESCRIPTION OF THE DRAWINGS

The method and the device for coating high-temperature components are explained in more detail with the aid of the exemplary embodiments illustrated in the drawings, in which.

DESCRIPTION OF THE PREFERRED EMBODIMENT

Figure 1:
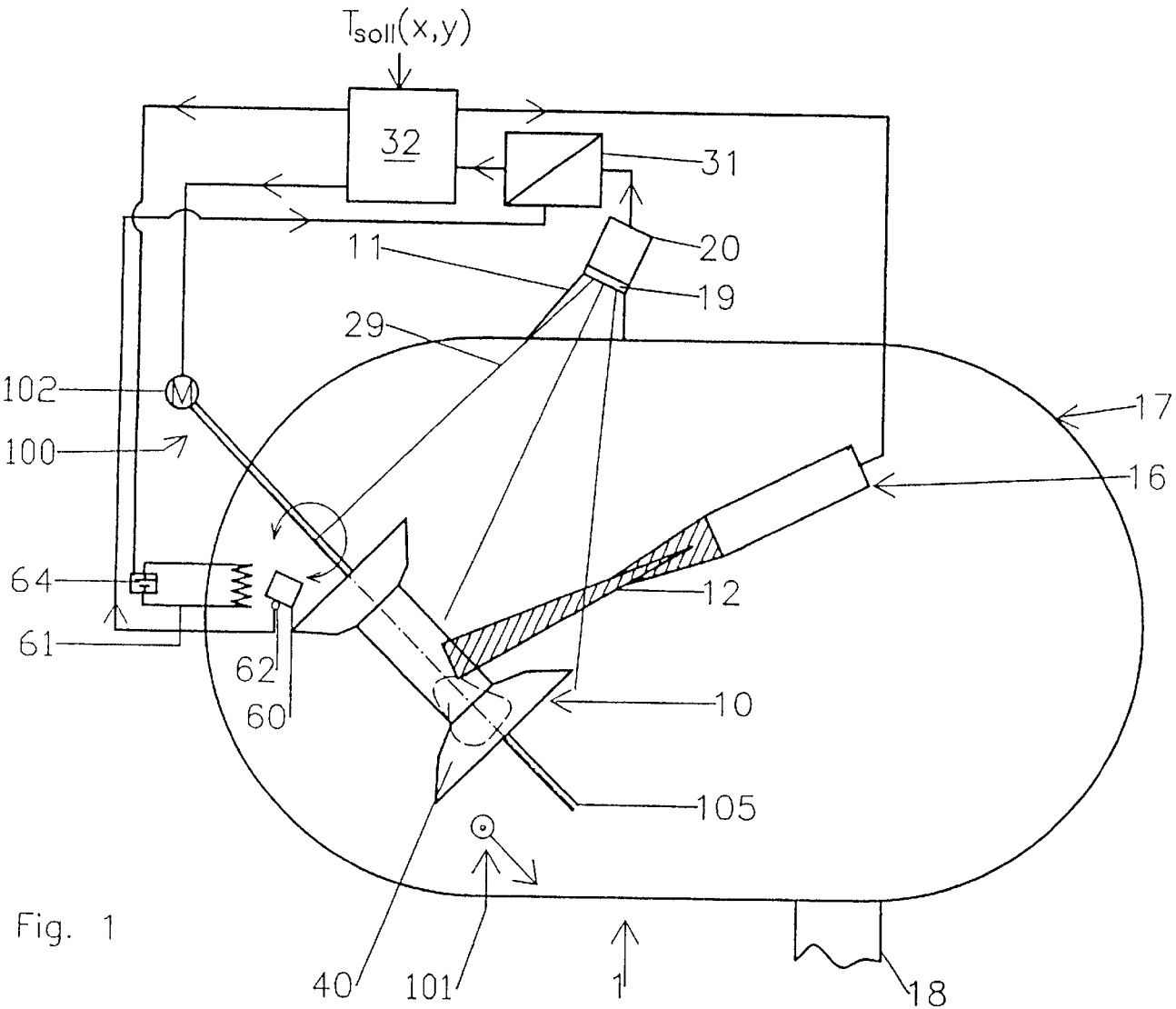
FIG. 1 shows a diagram of a device for coating by means of plasma spraying, having a coating chamber and infrared camera.
Figure 4:
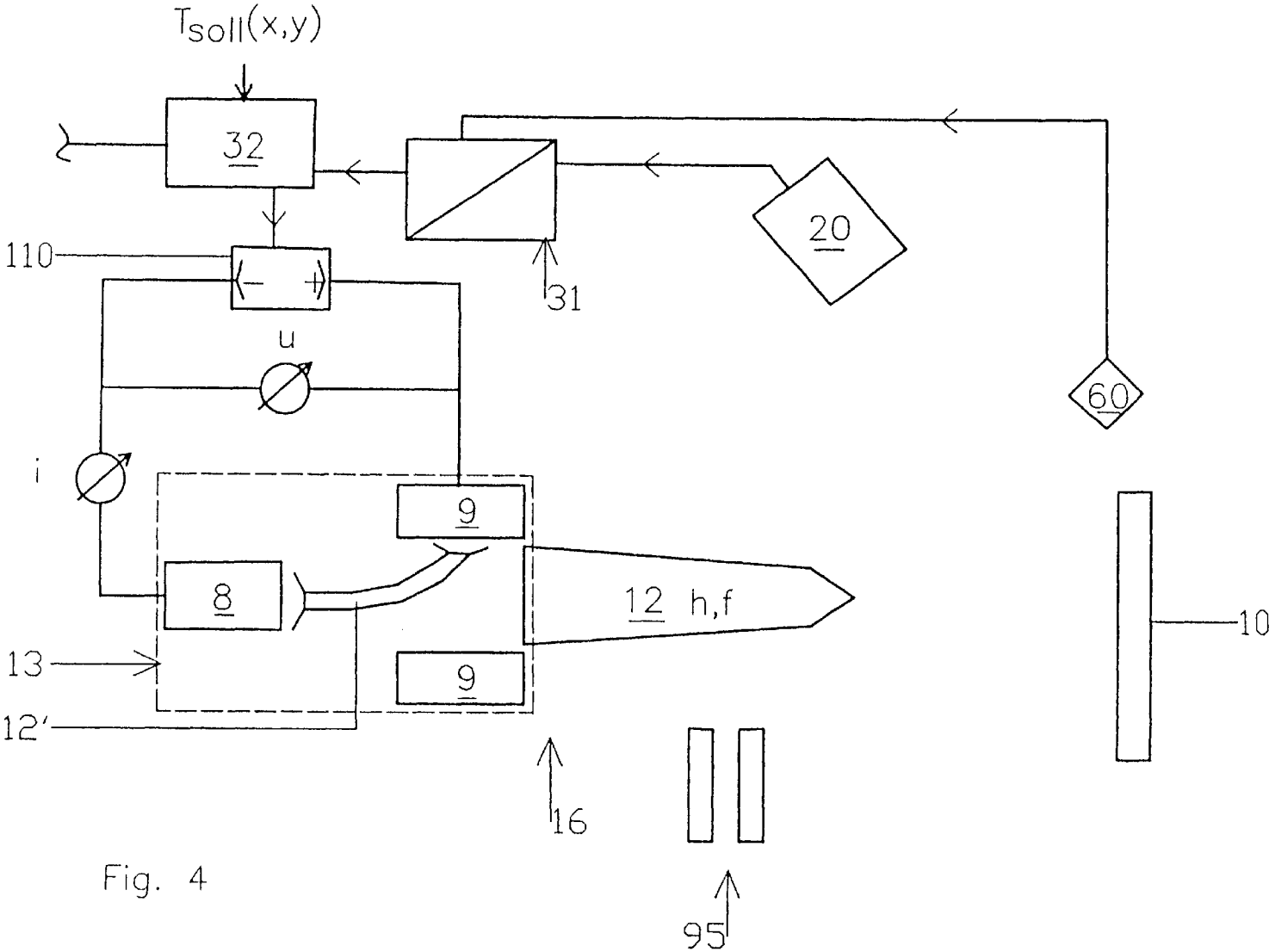
FIG. 4 shows a plasma spraying apparatus with control of the method parameter.

The principle of the design of a coating device 1 for carrying out a plasma spraying method is illustrated diagrammatically and not to scale in FIG. 1. The coating device 1 has a coating chamber 17 with an extraction stub 18 which is connected to a vacuum device (not shown). A plasma spraying apparatus 16 is arranged inside the coating chamber 17. The plasma jet 12 produced in the plasma spraying apparatus 16 is directed onto a component 10 to be coated, which is arranged in the coating chamber 17. The schematic design of the plasma spraying apparatus 16 is illustrated in FIG. 4. The plasma jet 12 permits both the heating of the component 10 and coating with the aid of a powder charge 95. The components 10 to be coated are essentially high-temperature components for use in gas turbines, for example turbine buckets or combustion chamber linings. The complex geometries such as those shown here by way of example entail inhomogeneities in heating, and thus in the thermal radiation distribution 30 of surface regions 40 of a component 10 to be coated. A traversing device for two perpendicular directions 101 or a rotation device 100 permits all the surface regions 40 of the component 10 which are to be coated to be reached, the result being that the plasma jet 12 need not be deflected over wide surface regions 40. Each surface region 40 of the component 10, including the narrow sides, can be quickly approached by rotation or displacement in mutually perpendicular directions. Alternatively, the position of the plasma jet 12 in relation to the component surface 40 can be varied by changing the position of the plasma spraying apparatus 16. The jet cone can also cover the entire, facing surface of the component 10.

The temperatures and temperature distributions 70 to be reached during the heating process of the component 10 with the aid of the plasma jet 12 are monitored by using an infrared camera 20 to take the thermal radiation distribution 30 (=thermal image) of the surface region 40 of the component 10. An example of a shot 25 taken with the infrared camera 20 is to be found in FIG. 2*a*. The infrared camera 20 is mounted on a glass window 19 which is fastened on a stub 11 which, in turn, is fitted on the coating chamber 17. The stub 11 prevents the glass window 19, and thus the view of the infrared camera 20, from being badly polluted by process dusts. The angle of the visual range 29 of the infrared camera 20 and the angular aperture of the conically shaped stub 11 are adapted to one another.

In order to reduce pollution of the glass window 19, the infrared camera 20 is arranged on the coating chamber 17 such that reflections of the radiation of the plasma jet 12 on the component surface do not catch the infrared camera 20. It must be ensured, moreover, that the infrared camera 20 can take a complete image of the thermal radiation distribution 30 of the component 10 in all positions. It is necessary for this purpose to carry out angular coordination such that the component 10 is always in the visual range 29 of the infrared camera 20 and, at the same time, the solid angle swept by the visual range 29 of the infrared camera 20 is preferably outside the solid angle of the reflection of the plasma jet 12.

A radiation reference means 60 is arranged next to the component 10 to be coated. Since both the component 10 and the radiation reference means 60 are simultaneously located in the visual range 29 of the infrared camera 20, the thermal radiation distributions 30 of the two can be recorded simultaneously by one shot 25. The radiation reference means 60 is heated by a heater 61 which is independent of the heater of the component 10, arid its temperature is determined by a thermocouple 62. This temperature is used as reference temperature $T_R$ for the purpose of determining the temperatures of the thermal radiation distribution 30 of the surface region 40 of the component 10.

Illustrated diagrammatically in FIG. 1 is the sequence of the measuring, transducing and control operation for the temperature management of the surface region 40 of the component 10. The thermal radiation distribution 30, taken by the infrared camera 20, of the surface region 40 and of the radiation reference means 60, and the temperature $T_R$, measured by the thermocouple 62, of the radiation reference means 60 are fed to the transducer 31. The latter determines therefrom the absolute temperature distribution 70 of the component surface 40 under inspection, and feeds this to the controlling system 32. Depending on the desired temperature distribution $T_{soll}(x,y)$ fed, the controlling system 32 determines the movement of the component 10, in particular by controlling the power supply of the rotation device 102, the power supply of the controllable current source 64 of the heater 62 of the radiation reference means 60, and the magnitude of the settable method parameter p of the plasma spraying apparatus 16.

The infrared camera 20 can, for example, also have an internal radiation reference means, that is to say one located inside the infrared camera 20, with the aid of which it is likewise possible to determine and assign temperature. However, it is preferable to determine temperature by using a radiation reference means 60 inside the coating chamber 17, because measurement errors which arise due to the plasma spraying process occur to the same extent in a shot of 25 simultaneously of the component 10 and the radiation reference means 60, and can thus be neglected or averaged out. For example, the measurement errors can arise through overlapping of different infrared radiation sources as stray radiation and background radiation, or from a time-dependent increase in the level of pollution of the glass window 19 from process dusts.

The glass window 19 preferably contains $Al_2O_3$. This type of glass, also termed sapphire glass, has good transmission properties in the region of electromagnetic waves with wavelengths between 2–5 $\mu$m, which corresponds to the measuring range of the infrared camera 20. This is necessary for accurate, discriminating characterization of the radiating surface region 40 of the component 10, since the plasma jet 12 constitutes a very broadband radiation source which, as set forth above, can overlap the radiation of the component. In the case of excessively intensive radiation, caused by the plasma jet 12, in the infrared region, suitable filters or other optical systems are connected upstream of the infrared camera 20.

Before coating with the plasma jet 12, the high-temperature component 10 is brought, on the surface region 40, to a predetermined preheating temperature, the threshold temperature $T_s$, in order to ensure better adhesion of the coating 15 which is to be applied. This preheating or heating during the coating process is preferably performed with the "pure" plasma jet 12 without powder charge 95. It is also possible for a plurality of surface regions 40 to be brought at least locally to predetermined threshold temperatures $T_s$. In order to reach a specific threshold temperature $T_s$ and a desired temperature distribution Tsoll (x,y) in the surface region 40, in the method presented a method parameter p of the plasma spraying process is set in accordance with the predetermined temperature distribution 70. It is also possible to set a desired temperature distribution Tsoll (x,y) which can, for example, be obtained from material-specific and component-specific measured values.

The relationship with the method parameter p to be set is explained in more detail with regard to FIG. 4. A quicker heat loss is to be expected in the case of thicker component sites and effectively conducting material, and so it is necessary there to undertake a longer thermal input, that is to say a parameter setting deviating from the usual setting. The result is then the desired temperatures or threshold temperatures $T_s$ at said sites. It is also possible to use other heat sources than the plasma jet 12 for the component 10, for example resistance heaters or inductive heaters.

Figure 2B:
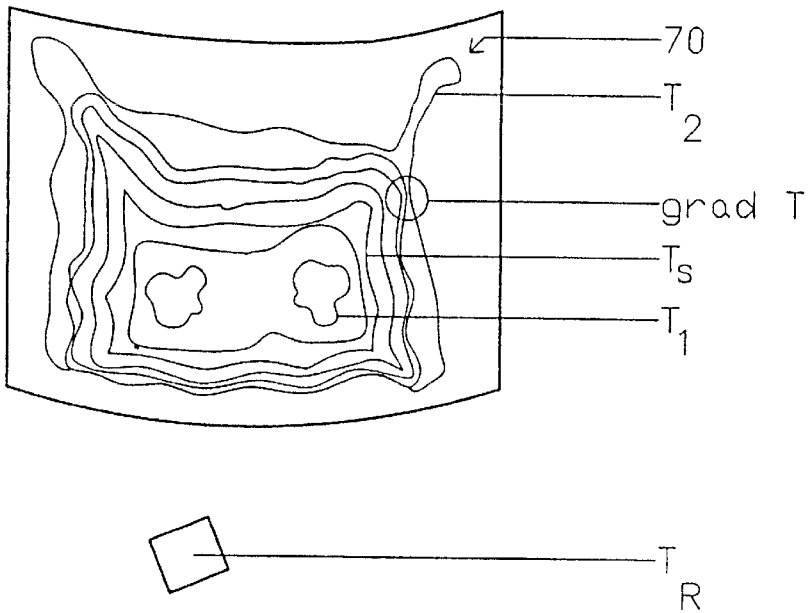
FIG. 2*b* shows a simplified, graphical illustration of a temperature distribution, as determined from a thermal distribution.
Figure 2A:
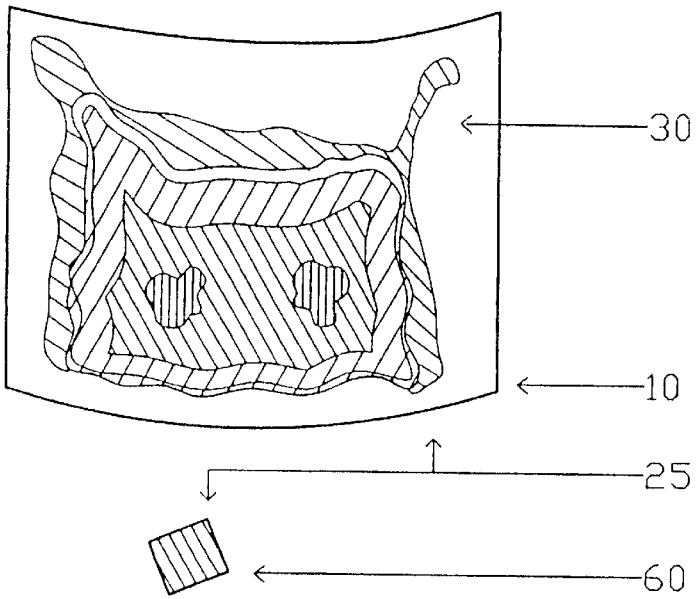
FIG. 2*a* shows a simplified, graphical representation of a shot of a thermal distribution taken with the aid of an infrared camera

FIG. 2*a* shows a schematic of a shot 25 of a thermal radiation distribution 30 of a surface region 40 of a heated component 10 and of a radiation reference means 60 which has been determined with the aid of an infrared camera 20. The variously hatched regions mark instances of thermal radiation of varying intensity or differences in frequency distributions.

FIG. 2*b* shows a schematic of the temperature distribution 70 which is obtained, with the aid of the infrared camera 20, by evaluating the shot 25 of the thermal distribution 30 of a surface region 40 of the component 10 and of the radiation reference means 60. Regions with temperatures T within predetermined limits $T_2<T<T_1$ are separated from one another by lines of equal temperature $T_i$, i=1,2, so-called isotherms. Regions with closely spaced isotherms are marked by large temperature gradients grad T. Preferably predetermined, maximum temperature differences $T_1-T_2$ and temperature gradients grad T which are as small as possible are to be observed in order to achieve optimum adhesion. By setting the method parameter p of the plasma jet 12, these regions can be subjected to a treatment which balances the temperature distribution 70. This setting can be undertaken by hand or with the aid of an electronic regulating or controlling system.

Figure 3:
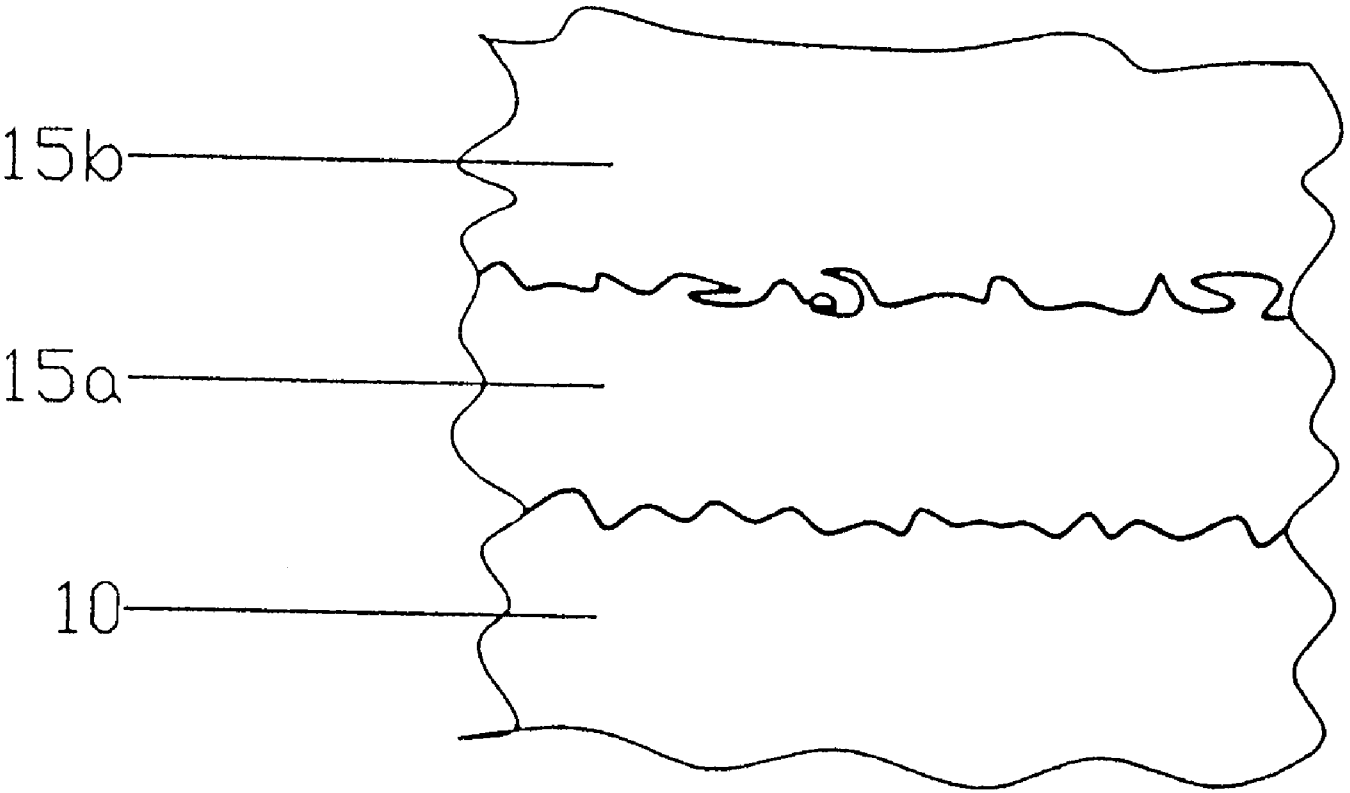
FIG. 3 shows a cross section through a coated component.

A cross section through a typical layer structure is shown in FIG. 3. A first layer 15*a* is applied to a component 10 using the VPS method, for example a CoCrAlY anticorrosion layer. A Y-stabilized $ZrO_2$ layer 15*b* ($ZrO_2+Y_2O_3$) serving as thermal barrier layer is subsequently applied. A roughened, clean surface of the component 10 is an important precondition for withstanding the thermal loads in high-temperature use. It is possible to clean the component 10 by means of sputtering in conjunction with negative polarity of the component 10. Mutually adapted coefficients of thermal expansion of the materials are also an important precondition. Otherwise, internal stresses cause the coating 15 to peel off.

In the case of preheating of the surface region 40, upon transition from a coating 15*a* to a coating 15*b* it is necessary as a rule to set other temperature values, because the threshold temperature $T_s$, the maximum temperature differences $T_1-T_2$ and the temperature gradient grad T to be observed depend on material and component and also, in particular, on the material combination. The surface temperature can be appropriately set quickly and with area coverage by an individual, material-specific setting of the method parameter p.

FIG. 4 illustrates diagrammatically a plasma jet source 13, a transducer 31 for converting the thermal radiation distribution 30, recorded by the infrared camera 20, of the component 10 for temperature distribution 70, and a controlling device 32 for setting up the plasma jet source 13 by means of the method parameter p in accordance with the temperature distribution 70 and the desired temperature distribution Tsoll (x,y). The plasma jet source 13 comprises two electrodes, formed as nozzles,—a negatively polarized cathode 8 and positively polarized anode 9—with a high applied voltage u and a working gas as atmosphere. High wall temperatures (approximately 3000 K) at the cathode 8 give rise to a thermionic field emission of electrons. The plasma electrons are accelerated by the E field in the direction of the anode 9. The working gas is heated by the arc discharge and ionized by impacts of atoms which are distant from the cathode 8 by more than the free ion-neutral particle exchange length. A local arc discharge 12' with the arc current i is produced inside the electrode nozzle.

The plasma jet 12 is free of current outside the electrode nozzle. This plasma jet 12 is used for coating together with feeding of a powder charge 95 to be applied. A reduction in the plasma gas flow f supplied leads to an increase in the plasma temperature given the supply of a constant electric power. The stability of the arc discharge 12' influences the entire plasma spraying process. Fluctuations in the production of plasma directly affect the state of the outflowing plasma jet 12, and thus, inter alia, also the temperature distribution 70 of the surface region 40 of the component 10 to be coated. The arc is shortened or lengthened by the movement of the arc root on the anode 9 in conjunction with a smooth arc current i which is held constant, as a result of which voltage fluctuations can occur. This, in turn, produces fluctuations in the plasma enthalpy h, and thus subjects the spray particles to thermal and dynamic influences. These fluctuations must be monitored for the purpose of setting the method parameter p reliably.

The method parameter p, which is varied in the method for the purpose of setting the desired temperature distribution in accordance with the determined temperature distribution 70, is, as illustrated above, preferably the arc current i of the arc discharge. Said arc current can be kept constant with the aid of circuits which are not very complicated. The variables responsible for good coating quality, such as the temperature, intensity and homogeneity of the jet as well as fusing of the powder charge 95 to be applied still depend, however, in a complex fashion on the various other method parameters p required for setting the plasma jet 12. Thus, for example, the abovementioned voltage u can be changed by changing the voltage between the electrodes, or the emission of the electrons from the cathode 8 can be changed by raising the heating power at the cathode 8. Gas pressure, gas flow, gas mixture, burner geometry, powder parameters, carrier gas flow, injection geometry and spraying distance, the position of the component 10 and of the plasma spraying apparatus 16, of the rotation axis 105 and of the duration of revolution tu of the component 10 also come into consideration as method parameter p. The enumeration of the method parameters p is not conclusive, it being possible to set all the method parameters p which influence the temperature distribution 70 of the component 10.

Figure 5:
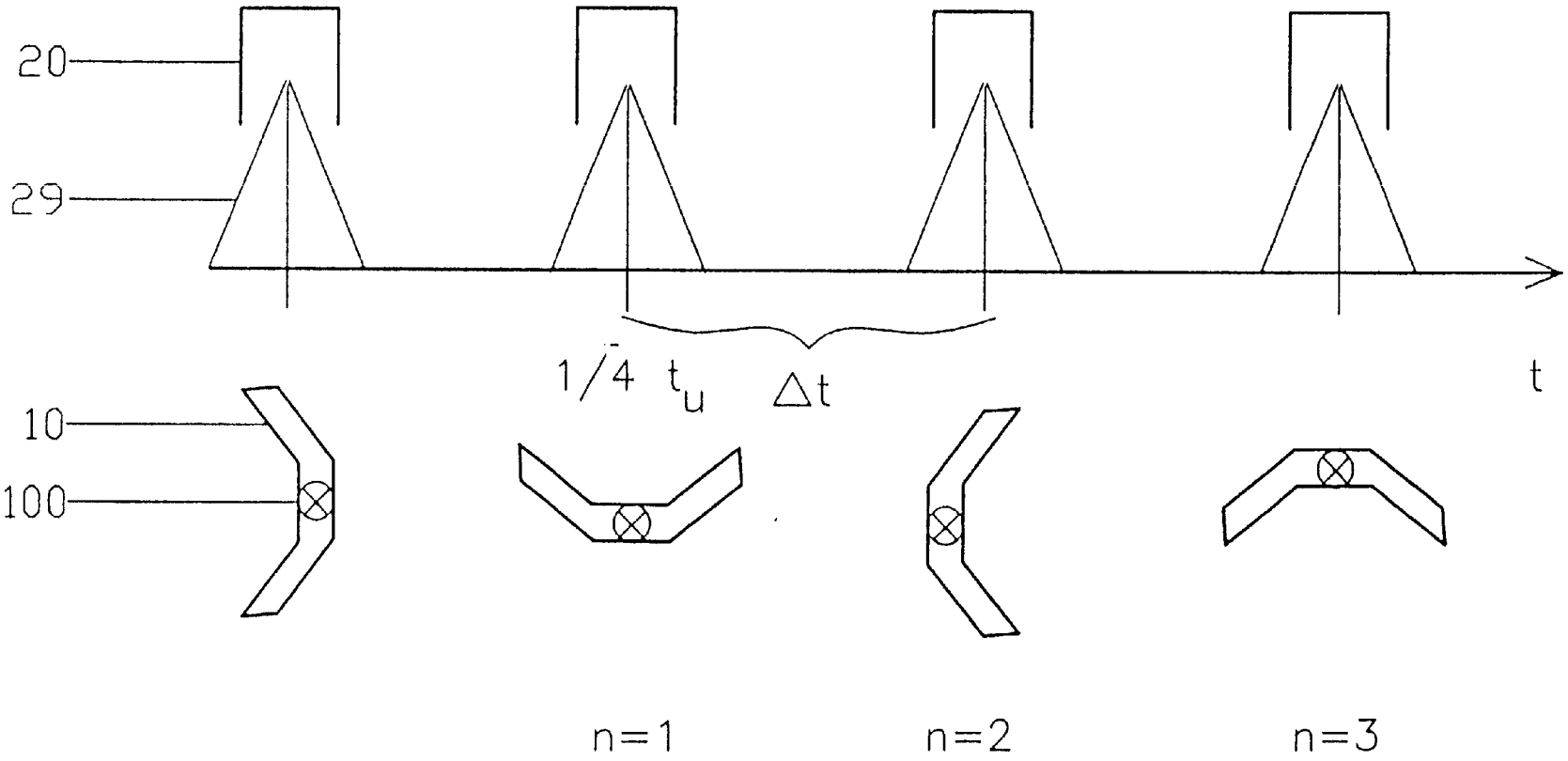
FIG. 5 shows an illustration to explain a triggered sequence of shots by the infrared camera in the case of a rotating component.

FIG. 5 illustrates by way of example a triggering, that is to say a coordination of the shots 25 of the infrared camera 20 with the rotation of the component 10. The shots 25 of the infrared camera 20 are indicated by a displacement of the infrared camera 20 over a timeline t. A more complex component 10 is rotated about its rotation axis 105 in 90° steps in each case. This renders it possible to take shots of the component 10 from all sides. In the case illustrated, the shots 25 of the infrared camera 20 have a preferred temporal spacing Δt of integral multiples n of a quarter or eighth of the period $t_u$ of a complete rotation. It therefore holds that for the temporal spacing of the shots. In the case of more complex components 10, a different division, for example into eighths, may be required. All the positions of the component 10 for the camera shots 25 are achieved in this way by suitably setting a temporal spacing Δt of the shots 25 in conjunction with suitable coordination with the period $t_u$ for a complete rotation of the component 10. It is possible in this way to compare with one another shots 25 of always the same surface regions 40 of the component 10 even in the case of rotations or other displacements. This is sensible, in particular, in the case of components 10 with greatly differing surface regions 40, because it is thereby possible to set the method parameter p more accurately.

In the case of other components 10 having surface regions 40 with very similar geometry, however, it is also possible, for example, to set the method parameter p by averaging the temperature over the circumference by means of a high rate of rotation and shots 25 with a lengthy exposure time. The temperature is then an average value over the entire component surface.

In the case of the triggering illustrated above, and of the averaging shooting technique, time-dependent setting of the method parameter p can also be sensible in addition to immediate setting, in order in this way to achieve a slower setting of the targeted desired temperature distribution Tsll (x,y), for example in order to avoid the production of thermal stresses and not to vary the surface properties of the component 10.

What is claimed is:

1. A method for coating a component by means of plasma spraying comprising the steps of:

(a) heating the component;

(b) determining a distribution of the thermal radiation of a surface region of the component with the aid of an infrared camera, said method having a method parameter (p) that said distribution is a function of;

whereby the parameter (p) is at least one out of an arc current (i) of the arc discharge of a plasma jet of a plasma spraying apparatus used for the plasma spraying, a voltage between electrodes, an emission of electrons from a cathode, a gas pressure, a gas flow, a gas mixture, a burner geometry, powder parameters of material to be coated, a carrier gas flow, an injection geometry, a spraying distance, the duration (tu) of a revolution of the component, a position of the component or a rotation axis of the component;

(c) determining the temperature distribution of the surface region from the thermal radiation distribution of the surface region of the component by comparison with the thermal radiation distribution of a radiation reference means, which is arranged inside a plasma spraying apparatus used for this method;

(d) setting the method parameter (p) in accordance with the temperature distribution in order to reach a prescribed threshold temperature ($T_S$) in the surface region; and, (e) plasma spraying the coating onto the component.

2. The method as claimed in claim 1, wherein the method parameter (p) is used to set, in the surface region of the component, a temperature distribution for which predetermined temperature differences ($T_1$–$T_2$) and/or temperature gradients (grad T) are not exceeded.

3. The method as claimed in claim 2, wherein the threshold temperature ($T_S$) is set with regard to an optimum adhesive power of the coating on the component, and/or in that the temperature differences ($T_1$–$T_2$) and/or temperature gradients (grad T) are limited, for the same purpose, only within predetermined ranges.

4. The method as claimed in claim 1, wherein a prescribed threshold temperature ($T_S$) is set, respectively, in a plurality of surface regions of the component.

5. The method as claimed in claim 1, wherein the method parameter (p) is controlled by comparing the temperature distribution of the surface region of the component with a desired temperature distribution (Tsoll (x,y)).

6. The method as claimed in claim 1, including the step of preheating and/or heating the component during the plasma spraying with a plasma jet, and wherein a parameter of the plasma jet is set as method parameter (p).

7. The method as claimed in claim 6, wherein the current (i) is set as method parameter (p).

8. The method as claimed in claim 6, including the step of varying the position of the component relative to the plasma jet and wherein the temperature distribution of the surface region of the component is determined in different relative positions.

9. The method as claimed in claim 6, including the step of varying the position of the component and wherein the positional variations of the component relative to the plasma jet, on the one hand, and a method parameter (p) of the plasma spraying, on the other hand, are coordinated with one another in accordance with the temperature distribution such that temperature gradients (grad T) of the surface region of the component are reduced.

10. The method as claimed in claim 1, including the step of rotating the component during plasma spraying with an optimum alignment of the surface region relative to the infrared camera.

11. The method as claimed in claim 10, including the step of successively triggering shots taken with the infrared camera, wherein the shots are triggered as a function of the rotational period ($t_u$) of the component.

12. The method as claimed in claim 11, wherein the triggering is carried out with the temporal spacing (Δt) of a quarter of a rotational period ($t_u$) or an integral (n) multiple thereof.

13. The method as claimed in claim 1, wherein the temperature distribution of the surface region of the component is determined as a function of time, and the method parameter (p) is set in accordance with the temporal response of the temperature distribution.

14. The method of claim 1 wherein the component is a gas turbine component.

15. A device for coating a component by means of plasma spraying with the aid of a plasma spraying apparatus including:

(a) a coating chamber, having an infrared camera which permits the thermal radiation of at least one surface region of the component to be observed;

(b) the plasma spray apparatus for depositing the coating on the component being at least partially positioned in or in spray communication with an interior of the chamber;

(c) a device for setting a method parameter (p) in accordance with the thermal radiation distribution observed, whereby the parameter (p) is at least one out of an arc current (i) of the arc discharge of a plasma jet of the plasma spraying apparatus, a voltage between electrodes, an emission of electrons from a cathode, a gas pressure, a gas flow, a gas mixture, a burner geometry, powder parameters of material to be coated, a carrier gas flow, an injection geometry, a spraying distance, the duration (tu) of a revolution of the component, a position of the component or a rotation axis of the component; and (d) a radiation reference means, which is arranged inside the plasma spraying apparatus, and with the aid of which signals of the thermal radiation distribution obtained from the infrared camera can be compared, and which serves to set the temperature distribution of the surface region of the component above a prescribed threshold temperature ($T_S$) and/or set the temperature distribution within a desired temperature distribution (Tsoll (x,y)) by means of adjustment of the method parameter (p).

16. The device as claimed in claim 15, including means for heating the radiation reference means independently of heat being applied to the component.

17. The device as claimed in claim 15, including a thermocouple for measuring the temperature of the radiation reference means.

18. The device as claimed in claim 15, wherein the radiation reference means is arranged in the monitoring field of the infrared camera inside the coating chamber proximate to the component to be coated, so that the radiation reference means and the component are simultaneously in the infrared camera's field of view.

19. The device as claimed in claim 15, wherein the infrared camera can be used to detect the entire surface region of the component facing it.

20. The device as claimed in claim 15, wherein the infrared camera is fitted at one end of an outwardly projecting stub of the coating chamber.

21. The device as claimed in claim 20, wherein the angular aperture of the stub and the visual range of the camera are adapted to coincide with one another, and the stub has a glass window screening the infrared camera.

22. The device as claimed in claim 21, wherein the glass window consists of a special glass having a transmission for wavelengths between 2–5 $\mu$m which is adapted to the measuring range of the camera.

23. The device as claimed in clime 21, wherein the glass window consists of sapphire glass.

24. The device of claim 20 wherein the component is a turbine bucket.

* * * * *